US005129762A

United States Patent [19]

Legendre

[11] Patent Number: 5,129,762

[45] Date of Patent: Jul. 14, 1992

[54] METALIC TUBULAR PILE EQUIPPED WITH A DEVICE ABLE TO INJECT GROUT CLOSE TO THE WALL OF THE PILE

[75] Inventor: Yves Legendre, Balloy/Bazoches-les-Bray, France

[73] Assignee: Entreprises Morillon Corvol Courbot S.A., Villeneuve-le-Roi, France

[21] Appl. No.: 648,203

[22] Filed: Jan. 31, 1991

[30] Foreign Application Priority Data

Feb. 6, 1990 [FR] France ..... 90 01324

[51] Int. Cl.[5] ..... E02D 5/28; E02D 7/00

[52] U.S. Cl. ..... 405/232; 405/233; 405/248

[58] Field of Search ..... 405/232, 233, 260, 269, 405/237, 238, 248, 243, 229, 225, 244

[56] References Cited

U.S. PATENT DOCUMENTS

| | | | |
|---|---|---|---|
| 3,494,134 | 2/1970 | Jorge | 405/260 |
| 4,000,623 | 1/1977 | Meardi | 405/260 |
| 4,386,876 | 6/1983 | Dupeuble | 405/260 |
| 4,902,171 | 2/1990 | Geffriaud et al. | 405/232 |
| 4,909,673 | 3/1990 | Barthelemy et al. | 405/231 |
| 4,948,301 | 8/1990 | Geffriaud et al. | 405/232 X |

FOREIGN PATENT DOCUMENTS

| | | | |
|---|---|---|---|
| 2569816 | 3/1986 | France . | |
| 2616508 | 12/1988 | France . | |
| 2158493 | 11/1985 | United Kingdom | 405/233 |

*Primary Examiner*—Dennis L. Taylor
*Attorney, Agent, or Firm*—Roland Plottel

[57] ABSTRACT

The invention concerns a metallic tubular pile equipped with a device allowing for the injection of grout close to the wall of the tube (12) forming the pile, said device being of the type comprising a tubular injection pipe (17) connected through a plurality of non-return valves to a plurality of injection orifices (16) traversing the wall, wherein at least one non-return valve (18) is mounted on the injection pipe (17) inside a transfer chamber (20) communicating with the corresponding injection orifice (16).

The invention can be used in anchorage pile applications for on-shore, river and/or sea foundations.

15 Claims, 2 Drawing Sheets

METALIC TUBULAR PILE EQUIPPED WITH A DEVICE ABLE TO INJECT GROUT CLOSE TO THE WALL OF THE PILE

FIELD OF THE INVENTION

The present invention is able to be used in applications for anchorage piles driven into the ground. Such piles are integrated in the foundations on piles embodied on-shore, on rivers and in the sea.

BACKGROUND OF THE INVENTION

The means are known on how to improve the anchorage capacity of metllic tubular piles by grouting, after driving, their walls to the terrain by means of cement grout. This grouting makes it possible to significantly increase the lateral friction of the pile with respect to the terrain and accordingly the resistance of the pile to compression effects, and especially traction effects. In order to do this, metallic tubular piles are already provided equipped with a device able to inject grout close to the wall of the tube forming the pile, this device being of the type comprising an injection pipe connected through a plurality of non-return valves to a plurality of injection orifices traversing the wall of the tube. In particular, one device described in the patent FR 2.237.475 contains non-return valves mounted in the actual wall of the tube of the pile, but without providing real protection.

SUMMARY OF THE INVENTION

The object of the invention is to provide a metallic tubular pile equipped with a simply-designed robust injection device able to be relatively easily installed on micropiles, small-diameter piles (for example, 600 mm) or on large-diameter piles (for example, 2,500 mm).

More particularly, the invention provides a metallic tubular pile equipped with a device making it possible to inject grout close to the wall of the tube forming the pile, said device being of the type comprising a tubular injection pipe connected through a plurality of non-return valves to a plurality of injection orifices opening close to the wall of the tube and divided along said tube, wherein at least one non-return valve is mounted on the injection pipe inside a transfer chamber communicating with at least one of said injection orifices..

It is to be noted that the disposition according to the invention of the non-return valves on the injection pipe itself makes it possible to limit the size of the openings made in the wall of the tube to the size of the actual injection orifices and thus avoid adversely affecting the resistance capacity of the tube. In addition, the non-return valves are fully protected by virtue of their position inside the transfer chambers. Finally, the rinsing of the valvves at the end of an injection operation is rendered easier by virtue of the disposition of the valves, thus eliminating the risk of a cement block forming at the inlet of the non-return valves.

According to a first embodiment of the invention, the non-return valves are constituted by collars made of an elastic material, such as elastomer, attached to the outside of the injection pipe with regard to perforations suitably distributed along the pipe. Advantageously, the internal volume of the transfer chamber is lined with an elastic fillig material and/or able to break open, such as polyurethane foam or wax.

According to another embodiment of the invention, the transfer chamber is provided with at least one injection orifice not traversing the wall of the tube.

Again, according to another embodiment of the invention, the transfer chamber is delimited on at least one of its sides by one portion of the wall of the tube, said portion being provided with at least one injection orifice traversing the wall of the tube. Advantageously, the injection pipe is divided into sections, each provided with one non-return valve, saaid transfer chambers being pre-mounted on said sections before being finally associated with the wall of the tube of the tubular pile.

According to a first variant of a tubular pile conforming to the invention, the transfer chamber is embodied from a tubular element traversed by the corresponding section of the injection pipe, said tubular element being welded to the wall of the tube of the pile around the injection orifice traversing said wall, and closed at its other extremity by a sealing plate, optionally pierced with another injection orifice. Advantageously, the tubular element comprises at least one enlarged opening allowing for mounting the injection pipe section provided with the non-return valve, said opening being blocked off by a coupling sleeve disposed around said injection pipe. Optionally, the coupling sleeve has an internal thread used for assembling two portions of the injection pipe. This first variant is particularlly suitably adapted to large-diameter tubular piles.

According to a second variant of a tubular pile conforming to the invention, the transfer chamber is embodied from one cylindrical section of the tube of the pile, said section having a reduced axial extension and closed at its two extremities by two circular sheet metal platesd traversed by the corresponding section of the injection pipe. Advantageously, the tube of the pile is obtained by the end-to-end fixing, such as by welding, of the transfer chambers with intermediate tubular elements. This second variant is particularly suitably adapted to small-diameter tubular piles.

BRIEF DESCRIPTION OF THE DRAWINGS

Other advantages and characteristics of the invention shall appear more readily from a reading of the following description with reference to the accompanying drawings in which.

DETAILED DESCRIPTION OF THE PREFERRED EMBODIMENTS

Figure 1:
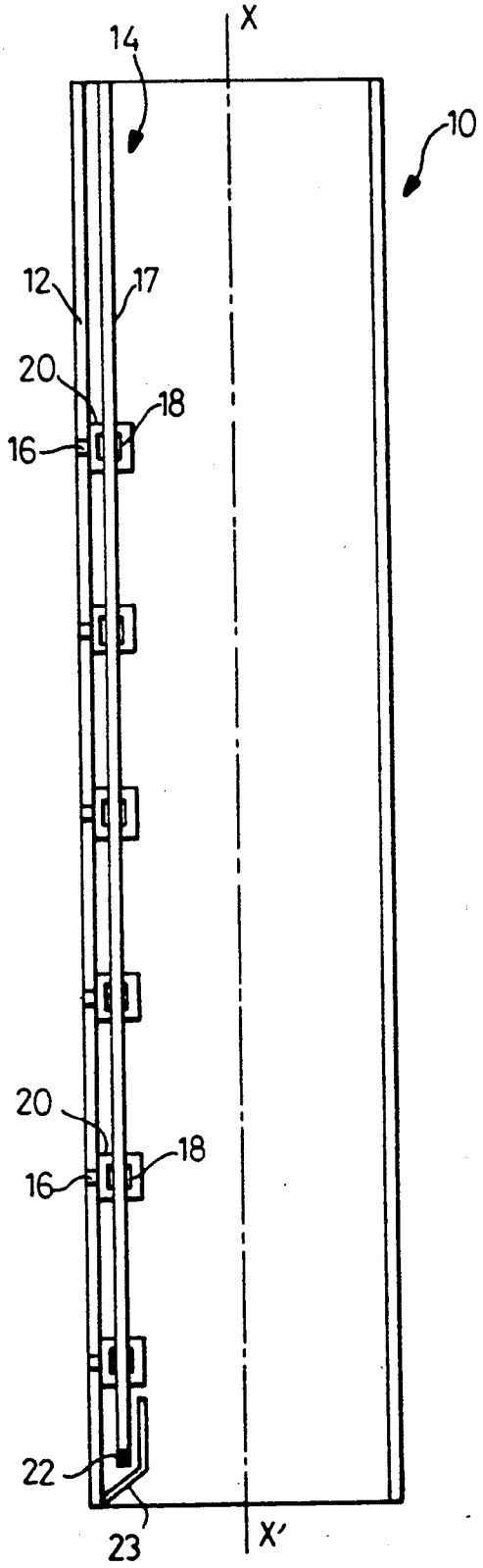
FIG. 1 shows a diagrammatic longitudinal axial cutaway view of a first embodimemnt of a tubular pile according to the invention.

The metallic tubular pile 10 of the invention shown in longitudinal section on FIG. 1 comprises a resistant steel tube 12 forming the actual structure of the pile equipped with a device 14 mounted inside the pile and allowing for the injection of cement grout (the section shown on FIG. 1 being embodied along a diametral plane of the tube 12 passing through is axis XX'). By way of non-resistive example, the tube 12 open at the foot possesses a large diameter (between 1 and 2 meters) for a length exceeding 30 meters. The tube 12 is pierced along a generator line with several injection orifices 16 thus traversing the wall of the tube and intended to allow for the outflow of the cement grout clost to the external face of the wall of the tube 12. These orifices 16 are regularly distributed along the tube according to a spacing of several meters (usually between 3 and 5 meters) and adapted to the characteristics of the desired pile grouting. Of course, without departing from the context of the invention, one variant (not shown) of the pile shown in FIG. 1 has several (for example 2, 3 or 4) injection devices similar to the device 14 and distributed regularly over the internal circumference of the circular section of the tube taken perpendicular to the longitudinal axis of the latter.

The injection device 14 includes an injection pipe 17 embodied from a metallic tube with a diameter of about 60 mm and on which non-return valves 18 are mounted intended to prevent the flowing back of the cement grout into the pipe 17. Each non-return valve is disposed inside a transfer chamber 20 communicating directly with one of the injection orifices 16 traversing the wall. The lower extremity, if FIG. 1 is considered, of the pipe 17 closed by a stopper 22 is protected by, especially when driving in the pile, a strong steel shield 23 with a conical head welded to the tube 12. It is to be noted that the location of teh non-return valves on the injection pipe makes it possible to reduce the diameter of the injection orifices 16 pierced through the wall of the tube 12 to the strict amount required for injection. This characteristic is advantageous as regards the mechanical resistance of the equipped tube.

In variants (not shown) of the pile of the invention, the injection pipe equipped with transfer chambers is mounted outside the pile, the transfer chambers being provided with orifices not traversing the wall of the tube (the grout is injected onto the outer face of the wall of the tube) and/or orifices traversing the wall of the tube (the grout is injected onto the internal face of the tube).

Figure 2:
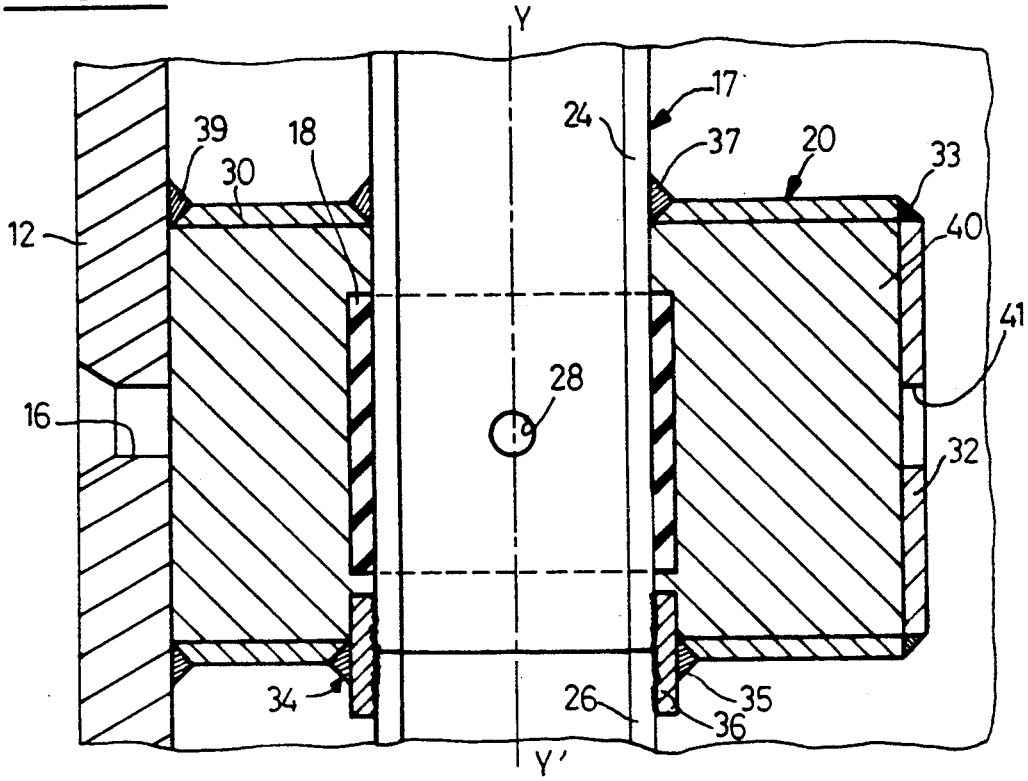
FIG. 2 shows a partial increased view of the pile shown on FIG. 1 and in which a transfer chamber is shown in section along the diametral plane of the tubular pile passing through the axis YY' of the injection pipe.

The partial enlarged view represented on FIG. 2 shows one portion of the tube 12 associated with a transfer chamber 20 and makes it possible to observe the embodiment and mounting details of the various essential elements of the injection device 14. More particularly, the section illustrated on FIG. 2 is embodied along the diametral plane common between the tube 12 (along the axis XX') and the pipe 17 (along the axis YY').

As shown on FIG. 2, the injection pipe 17 is embodied by a plurality of sections 24, 26 each bearing one non-return valve 18 constituted by a collar made of an elastomer material, such as rubber, attached to the outside of the pipe 17 so as to cover one or several perforations 28 made in the pipe 17 approximately to the right of the injection orifice 16. As shown on FIG. 2, the orifice 16 is bulged towards the outside of the tube 12. Around the valve 18 and opposite the orifice 16, the transfer chamber 20 made up of welded sheet steel elements is secured to the wall of the tube 12. More specifically, the casing of the transfer chamber 20 is constituted by a tubular element 30 disposed perpendicular to the axis YY' and closed by a plate 32 welded at 33. The tubular element 30, having a square, rectangular or circular section, is traversed right through by the section 24 and, at its lower portion, has one enlarged opening 34 allowing for mounting of the section 24 equipped with the non-return valve 18. The enlarged opening 34 is closed by a coupling sleeve 36 welded at 35 to the tubular element 30. The sleeve 36 is provided with an internal thread able to receive firstlly the threaded extremity of the section 24 and secondly the threaded extremity of the following section 26 so as to assemble the two sections of the pipe 17. The upper portion of the tubular element 30 is welded at 37 to the section 24, whereas the extremity of this sleeve 30 situated opposite the orifice 16 is welded at 39 onto the internal wall of the tube 12 around this orifice 16. All the weldings may be effected relatively easily from outside the transfer chamber. In practice, initially the transfer chambers are pre-assembled and are mounted onto the pipe 17, followed by welding of the tubular sleeves 30 onto the wall of the tube 12 at the right of the previously pierced orifices 16.

Moreover, the inside part of the chamber is lined with a filling material 40 with elastic characteristics and/or able to break open, such as expansible polyurethane foam or wax. This lining prevents earth entering the transfer chamber 20 during and after driving in of the pile. When cement grout is injected under pressure, this compressible (or fracturable) lining is able to contract (or break open) so as to firstly allow the collar 18 to be freed from the wall of the tube 24, and secondly allow the grout to flow towards the orifice 16, whilst avoiding a grout plug forming after injection, either via the recovery of its initial volume in the case of a compressible lining, or via the reduced dimensions of the passage available for the grout in the case of a fracturable lining. Thus, if need be, it is possible to restart the injection operation through the orifice in question. Furthermore, in the event of an unexpected formation of a resistant grout film, the internal volume of the transfer chamber is sufficiently large so as to allow the grout at the time of a new injection to clear another passage in the lining material towards the corresponding injection orifice.

The installing in the ground of the pile of the invention is embodied conventionally by driving in the tube 12, for example, by hammering or vibratory driving. The grout is then injected with the aid of a grout injection line (not shown) equipped with two sealers, such as inflatable sealers, and is lowered into the pipe 17 so as to place under pressure one portion of the pipe 17 overlapping the non-return valve 18 in communication with one specifc orifice 16. The pressurizing of this portion allows the grout to flow through the performation(s) 28, the valve 18 and the orifice 16 so as to grout the external wall of the tube 12 and improve the lateral friction of the tube with respect to the surrounding terrain. The grout is conventionally injected from the foot of the pile through the first orifice and then progressively ascending orifice by orifice. Throughout the entire operation, the injection pressure and the injected grout volume are controlled by any known means. At the end of the operation, the injection line is withdrawn and the pipe cleaned with water. In this repect, it is to be noted that the cleaning with water is effected relatively easily in the devices of the invention in the absence of any pipe connections between the non-return valves and the injection pipe (these connections generally present difficult access to the flow of rinsing water and favor the formation of grout plugs).

Optionally, the plate 32 is pierced with an injection orifice 41 allowing the grout to the injected along the internal face of the wall of the tube 12 so as to improve the lateral friction of the pile on the terrain plug inside the tube. Thus, the invention provides, apart from other devices, a simple injection device which, from a single non-return valve, simultaneously allows for the injection onto the external and internal faces of the wall of the tube 12.

It is to be noted that the implementation of the invention renders it relatively simple to make successive injections at a given terrain level (the corresponding orifice 16 still remaining freely accessible) and even to modify the types of grout used (for example, using chemical grouts and silica gels or synthetic consolidation agents, especially resins).

Figure 3:
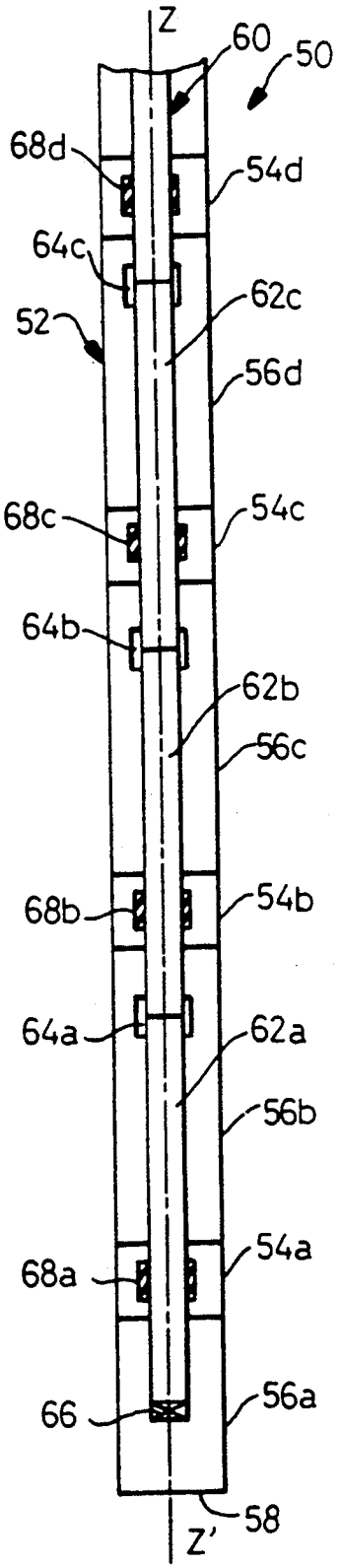
FIG. 3 is a diagrammatic longitudinal axial cutaway view of a second embodiment of the tubular pile according to the invention.

In the second embodiment of a metallic tubular pile 50 according to the invention and diagrammatically shown in longitudinal section on FIG. 3, the resistant steel tube 52 forming the actual structure of the pile is embodied by assembling end-to-end along the axis ZZ' of the tube transfer chambers 54 (54*a* to 54*d*) with tubular intermediate elements 56 (56*a* to 56*d*) with a length of between 3 and 5 meters.

So as to avoid overload numbering, certain elements shown in mutliple form on FIG. 3, for example the transfer chambers, have been indexed from "a" to "d" from the foot of the tube 52. However, this indexing shall only be used in the rest of the description, if need be.

The tube 52 may optionally be closed at the foot by a shoe 58. The injection pipe 60, made up of sections 62 (62*a* to 62*c*) assembled by screw couplings (64*a* to 64*c*), is disposed coaxially with respect to the tube 52. The injection pipe 60 is closed at the foot by a stopper 66, a sufficient distance being provided between the stopper 66 and the first transfer chamber 54*a* so as to allow for the full descent into the pipe 60 of the lower sealer of the injection line (not shown). Furthermore, each transfer chamber contains one non-return valve 68 (68*a* to 68*d*) mounted on the injection pipe 60.

Figure 4:
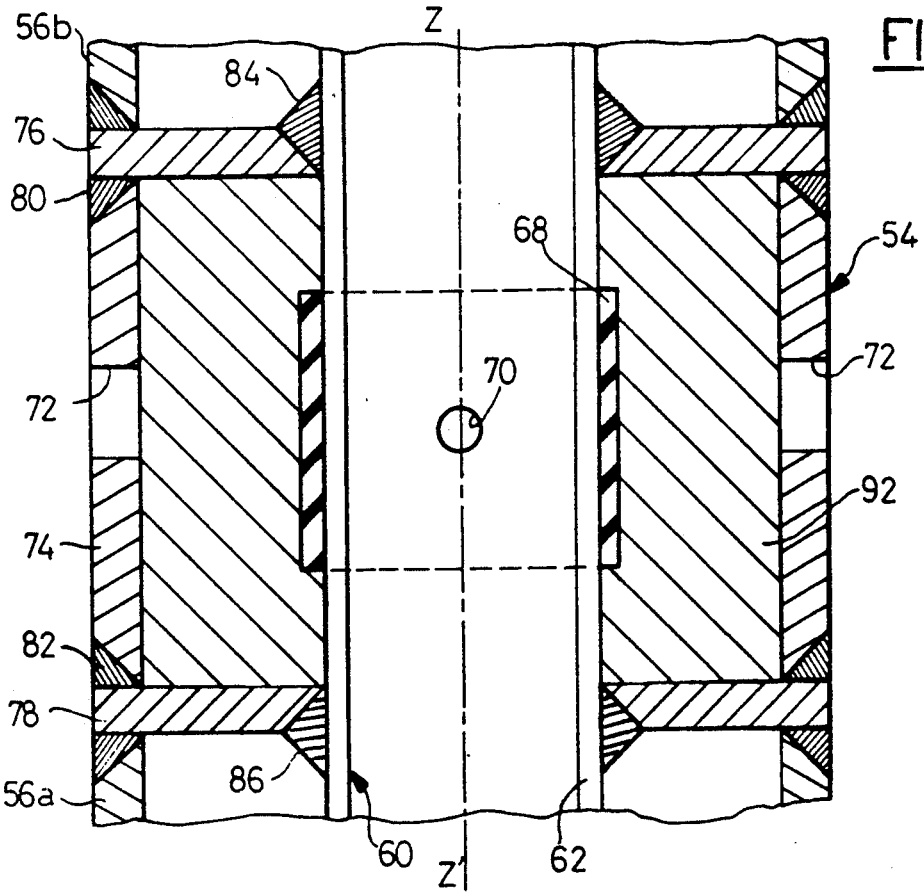
FIG. 4 shows a partial enlarged view of the pile shown in FIG. 3 and in which one transfer chamber is shown in axial section.

As shown on FIG. 4, one section 62 of the pipe 60 bears the rubber collar 68 constituting the non-return valve attached to the outside of this section 62. The collar 68 covers one or several perforations 70 made in the section 62 at the right of the injection orifices 72 traversing the wall of the tube 52 and disposed symmetrically with respect to the axis ZZ' (in this case, the two orifices 72 are diametrally opposed).

The transfer chamber 54 is embodied from sheet metals welded from a cylindrical section 74 of the wall of the tube 54. The section 74 with a limited axial extension (about several decimeters) is closed (after placing the collar) by two circular sheet metal plates 76 and 78 welded at 80 and 82 at their peripheries, as shown on FIG. 4. The plates 76 and 78 provided with central openings are traversed by the section 62 and welded to the latter at 84 and 86. Finally, the plates 76 and 78 are welded at their peripheries to the two adjacent tubular elements 56 (for example 56*a* and 56*b*) at 88 and 90, as shown on FIG. 4. In addition, the internal volume of the chamber 54 is lined with a filling material 92 with elastic characteristics and/or able to break up, such as expansible polyurethane foam or wax.

It is to be noted that the tubular elements 56 and the sections 74 have identical dimensions as regards their diameters and thicknesses and are obtained from the same grade of steel so as to guarantee resistance characteristics approximately identical along the entire tube 52 forming the structure of the pile.

The assembling of the pile 50 is effected as follows. Initially, each section 62 is equipped with a rubber collar 68 and a transfer chamber 54. After the plug 66 has closed the first equipped section 62*a*, the bottom plate of the chamber 54*a* is welded with a first tubular element 56*a*, which is closed by the shoe 58. The screw coupling 64*a* is next mounted onto the free extremity of the section 62*a*. Then the other bottom plate of the chamber 54*a* is welded with the tubular element 56*b*. The operation is repeated by identical sequences for the other essential elements of the tube according to a mounting sequence marked on FIG. 3 by the letters a, b, c, d . . . , each new sequence commencing via the screwing of the new pipe section 62 onto the coupling 64 already mounted on the previous section.

It is to be noted that the equipped pile shown on FIGS. 3 and 4 has a simple robust structure and is relatively easy to assemble. In addition, a given transfer chamber is able to feed, from a single non-return valve, several orifices situated at a specific pile level and distributed over its circumference.

The placing and grouting of the pile 50 is effected similarly to the method already described for the pile 10 and shall not in this instance be further described in detail. Depending on the type of pile head used to drive in the pile, it may be necessary to slightly shorten the final section (upper section) of the injection pipe with respect to the final tubular element.

The invention is not merely limited to the use of rubber collar type non-return valves, but also includes the use of any other type of non-return valves localized (not shown) on the injection pipe, such as valves constituted by split collars mounted on the outside of the pipe to the right of the perforations allowing for passage of the grout, or valves constituted by slits with ductile lips made through the wall of the injection pipe.

What is claimed is:

1. Metallic tubular pile equipped with a device able to inject grout close to the wall of the tube forming the pile, said device being of the type comprising a tubular injection pipe connected through a plurality of non-return valves to a plurality of injection orifices opening close to the wall of the tube and distributed along said tube, wherein at least one non-return valve is mounted on the injection pipe inside a transfer chamber communicating with at least one of said injection orifices, said transfer chamber having an internal volume lined with a filling material with elastic properties and/or able to break open and being enlarged in size so as to permit successive grout passages towards the corresponding injection orifice.

2. Metallic tubular pile according to claim 1, wherein the non-return valves are constituted by collars made of an elastic material, such as elastomer, attached to the outside of the injection pipe with respect to perforations suitably distributed along said injection pipe.

3. Metallic tubular pile according to claim 1, wherein the non-return valves are constituted by split collars mounted onto the outside of the injection pipe with respect to perforations suitably distributed along said injection pipe.

4. Metallic tubular pile according to claim 1, wherein the non-return valves are constituted by ductile lip slits made through the wall of the injection pipe.

5. Metallic tubular pile according to claim 1, wherein the filling material with elastic properties and/or able to break open is made of polyurethane foam or wax.

6. Metallic tubular pile according to claim 1, wherein said transfer chambers are made of sheet metal elements, such as welded tubes and/or plates.

7. Metallic tubular pile according to claim 1, wherein the transfer chamber is provided with at least one injection orifice not traversing the wall of the tube.

8. Metallic tubular pile according to claim 1, wherein the transfer chamber is delimited on at least one of its sides by one portion of the wall of the tube, said portion being provided with at least one injection orifice traversing the wall of the tube.

9. Metallic tubular pile according to claim 8, wherein the injection pipe is divided into sections, each provided with one non-return valve, said transfer chambers being pre-assembled on said sections before being finally associated with the wall of the tube of the tubular pile.

10. Metallic tubular pile according to claim 8, wherein the transfer chamber is embodied from a tubular element traversed by the corresponding section of the injection pipe, said tubular element being welded at one extremity to the wall of the tube of the pile around the injection orifice traversing said wall of the tube and closed at its other extremity by a sealing plate, said plate being optionally pierced with one injection orifice.

11. Metallic tubular pile according to claim 10, wherein the tubular element comprises at least one enlarged opening so as to allow for mounting of the injection pipe section provided with the non-return valve, said opening being sealed off by a coupling sleeve disposed around said injection pipe.

12. Metallic tubular pile according to claim 11, wherein the coupling sleeve has an internal thread used for assembling two sections of the injection pipe.

13. Metallic tubular pile according to claim 1, wherein the transfer chamber is embodied from one cylindrical section of the tube of the pile, said section having a reduced axial extension and closed at its two extremities by two circular steel metal plates traversed by the corresponding section of the injection pipe.

14. Metallic tubular pile according to claim 13, wherein the tube of the pile is obtained by the end-to-end fixing, such as welding, of the transfer chambers with intermediate tubular elements.

15. Metallic tubular pile according to claim 1, said pile being driven and grouted into the ground by injecting a cement grout close to the wall of the tube forming said pile.

* * * * *